166-66 SR
4/3/84 XR 4,440,219

United States Patent [19]
Engelder

[11] 4,440,219
[45] Apr. 3, 1984

[54] THERMALLY ISOLATED WELL INSTRUMENTS

[75] Inventor: Paul D. Engelder, Rancho Palos Verdes, Calif.

[73] Assignee: AMF Inc., White Plains, N.Y.

[21] Appl. No.: 457,059

[22] Filed: Jan. 10, 1983

[51] Int. Cl.[3] ..... E21B 36/00
[52] U.S. Cl. ..... 166/57; 166/302; 166/66
[58] Field of Search ..... 166/57, 64, 66, 113, 166/302; 250/269; 165/45, DIG. 4

[56] References Cited

U.S. PATENT DOCUMENTS

| | | | |
|---|---|---|---|
| 3,038,074 | 6/1962 | Scherbatskoy | 250/83 |
| 3,049,620 | 8/1962 | George et al. | 250/71.5 |
| 3,069,520 | 12/1962 | Kovacik | 165/DIG. 4 |
| 3,265,893 | 8/1966 | Rabson et al. | 250/71.5 |
| 3,435,629 | 4/1969 | Hallenburg | 62/259 |
| 3,648,767 | 3/1972 | Balch | 165/45 |
| 3,702,932 | 11/1972 | Tanner et al. | 250/269 |
| 3,836,779 | 9/1974 | Bruno et al. | 250/352 |
| 3,859,523 | 1/1975 | Wilson et al. | 250/261 |
| 3,922,008 | 11/1975 | Stiner et al. | 165/45 |
| 3,935,911 | 2/1976 | McQueen | 175/17 |
| 4,009,418 | 2/1977 | Bennett | 361/38 |
| 4,118,756 | 10/1978 | Nelson et al. | 361/385 |
| 4,315,417 | 2/1982 | Zarudiansky | 62/514 R |

OTHER PUBLICATIONS

"Design, Developement and Test of a 1000-Watt Osmotic Heat Pipe", Basiulis et al, Hughes Aircraft Company.
"A High Reliability Variable Conductance Heat Pipe Space Radiator", Fleischman et al, Hughes Aircraft Company.
"Vapor Chambers for an Atmospheric Cloud Physics Laboratory", Fleischman et al.
"Noren Heat Pipes", Noren Products, Inc.
"Emerging Heat Pipe Applications", Basuilis et al, Hughes Aircraft Company.
"Development of an Osmotic Heat Pipe", Minning et al, Hughes Aircraft Company.
"Reliability of Low-Cost Liquid Metal Pipes", Ewell et al, Hughes Aircraft Company.
"Hughes 1350H Series Stainless Steel and Methanol Heat Pipes", Hughes Aircraft Company.
"Hughes 1370H Series Copper and Water Heat Pipes", Hughes Aircraft Company.
"Hughes 1395H Series Stainless Steel/Ammonia Variable Conductance Heat Pipers for Space Applications", Hughes Aircraft Company.
"PDA Thermoshield", PDA Engineering.

*Primary Examiner*—Stephen J. Novosad
*Assistant Examiner*—William P. Neader
*Attorney, Agent, or Firm*—David E. Dougherty; John H. Gallagher

[57] ABSTRACT

A well instrument is isolated from the high temperatures of a surrounding earth formation by enclosing the instrument within a heat insulative jacket structure, preferably a dewar having spaced walls with a vacuum therebetween, with a heat sink contained in the jacket above the instrument assembly, and with a heat pipe extending upwardly from the instrument assembly to the heat sink and containing a fluid which by evaporation at a lower point and condensation at a higher point will conduct heat upwardly from the instrument assembly to the heat sink but not downwardly therebetween. The heat pipe preferably projects upwardly beyond a top portion of the insulating jacket to the location of a convector element which is exposed to the temperature of fluid or air at the outside of the insulating jacket to transmit heat from within the jacket to its exterior but not in a reverse direction.

20 Claims, 7 Drawing Figures

THERMALLY ISOLATED WELL INSTRUMENTS

BACKGROUND OF THE INVENTION

This invention relates to improved well instruments which are protected against high formation temperatures.

Many types of instruments which are lowered into wells in order to sense a desired condition or perform a a desired operation include components which can be damaged or otherwise adversely affected by the often very high downhole temperatures encountered in wells. For example, surveying instruments and directional drilling steering tools may contain sensors responsive to inclination and direction which can not operate satisfactorily at extremely high temperatures. Because of the very limited horizontal cross-sectional area of a well bore, it is extremely difficult to effectively protect the interior parts of such an instrument from the high temperature of the downhole environment, and consequently it is often necessary to limit drastically the amount of time an instrument is allowed to remain in the well performing the sensing or other operation, and then quickly pull the instrument out of the hole before damage or other adverse effect can occur. The problem is compounded by the fact that the instrument in operation may itself develop additional heat which will tend to raise the temperature of the instrument and related equipment even if it is isolated relatively effectively from the temperature of the surrounding formation.

U.S. Pat. Nos. 3,265,893 issued Aug. 9, 1966 to T. A. Rabson et al. and 3,859,523 issued Jan. 7, 1975 to Wilson et al. show well logging instruments which are enclosed within dewar flasks, that is, containers having spaced walls with a vacuum therebetween, to heat insulate the interior of the container from its exterior. These dewar structures in the two mentioned patents also contain heat sinks for absorbing heat developed in the interior of the dewars. U.S. Pat. No. 3,859,523 specifies that the heat sink may be formed of a fusible material acting to absorb heat at a constant temperature during melting.

U.S. Pat. No. 3,435,629 issued Apr. 1, 1969 to J. K. Hallenburg shows a device including downhole electrical apparatus contained within a dewar which also contains a body of water from which vapor is withdrawn by a pumping system to the exterior of the dewar to maintain a desired vapor pressure and thus attain a desired water and instrument temperature within the dewar, and with the water being forced to condense at high pressure at the outside of the dewar.

SUMMARY OF THE INVENTION

The present invention provides an improved arrangement for more effectively thermally isolating a well instrument from the adverse effects of high downhole temperatures, and doing so over a relatively long period of operation of the instrument. An assembly embodying the invention can be lowered into a hole of very small diameter, and in spite of that small diameter can prevent transmission of any substantial heat from the formation into the interior of the instrument. Such heat as may be generated by the components of the instrument is transmitted very effectively from the instrument to a heat sink for absorption thereby, with both the instument and heat sink being contained within an outer insulating jacket structure, preferably a dewar flask. Reverse heat conduction from the heat sink back to the instrument is prevented automatically by a unique arrangement of parts. The apparatus may also be designed to enable conduction of heat from the interior to the exterior of the insulated jacket, and to the surrounding earth formation, during periods when the liquid, air and formation at the outside of the jacket are a lower temperature than the instrument and heat sink within the jacket. However, reverse conduction of heat from the exterior of the insulating jacket to its interior, when the exterior temperature is above that within the jacket, is prevented.

These results are achieved by positioning the heat sink within the insulating jacket structure at a location above the instrument assembly, and also providing within the jacket structure a heat pipe which extends upwardly from the instrument assembly to the heat sink. This heat pipe contains a fluid which only partially fills the heat pipe and is in liquid form in the lower portion thereof to absorb heat from the instrument assembly. Heat from the instrument vaporizes some of the liquid to flow upwardly through the heat pipe and condense in an upper portion thereof in heat conducting relation to the heat sink, so that latent heat may be transmitted from the vapor to the heat sink, after which the condensed fluid flows downwardly to the lower portion of the pipe for re-evaporation.

One-way conduction of heat from the interior of the flask to its exterior, but not in the reverse direction, is attained by extending the heat pipe upwardly beyond the heat sink and to the exterior of the insulating jacket structure, and preferably to a point of connection with a convector element from which heat may be dissipated to air or liquid in the well and to the surrounding formation.

BRIEF DESCRIPTION OF THE DRAWINGS

The above and other features and objects of the invention will be better understood from the following detailed description of the typical embodiment illustrated in the accompanying drawings, in which.

DESCRIPTION OF THE PREFERRED EMBODIMENT

Figure 1:
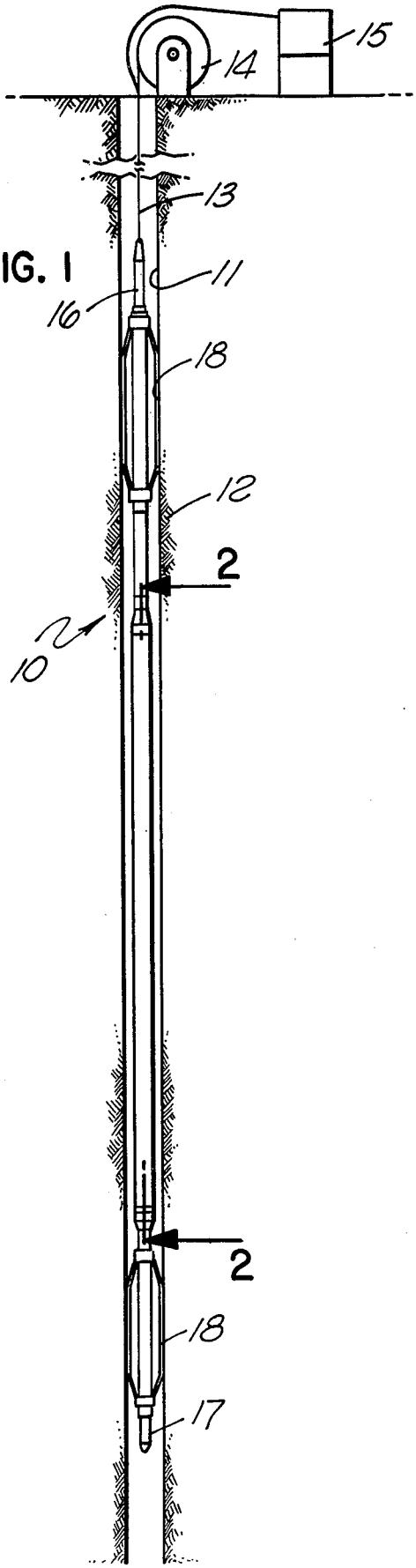
FIG. 1 is a view representing apparatus embodying the invention lowered into a well bore.

In FIG. 1, a device embodying the invention is illustrated at 10, positioned deep within a well 11 at a location at which the temperature of the formation 12 surrounding the well is very high, say for example five hundred degrees Fahrenheit (500° F.) or in excess thereof. The survey instrument 10 is lowered into the well on a wire line 13 wound on a drum 14 at the surface of the earth, with that wire line typically containing single or multiple conductors leading to the operative portions of the device 10, to conduct power to the instrument and return information to a readout unit 15 at the surface of the earth through cable 13 and a ground connection constituting the opposite side of the circuit. The survey tool 10 may be centered in the well, or within a well pipe, by connection of upper and lower sections 16 and 17 to the upper and lower ends of instrument 10, with each of these sections 16 and 17 having conventional centering springs 18 for contacting the bore wall or a well pipe to locate device 10 centrally therein.

Figure 2A:
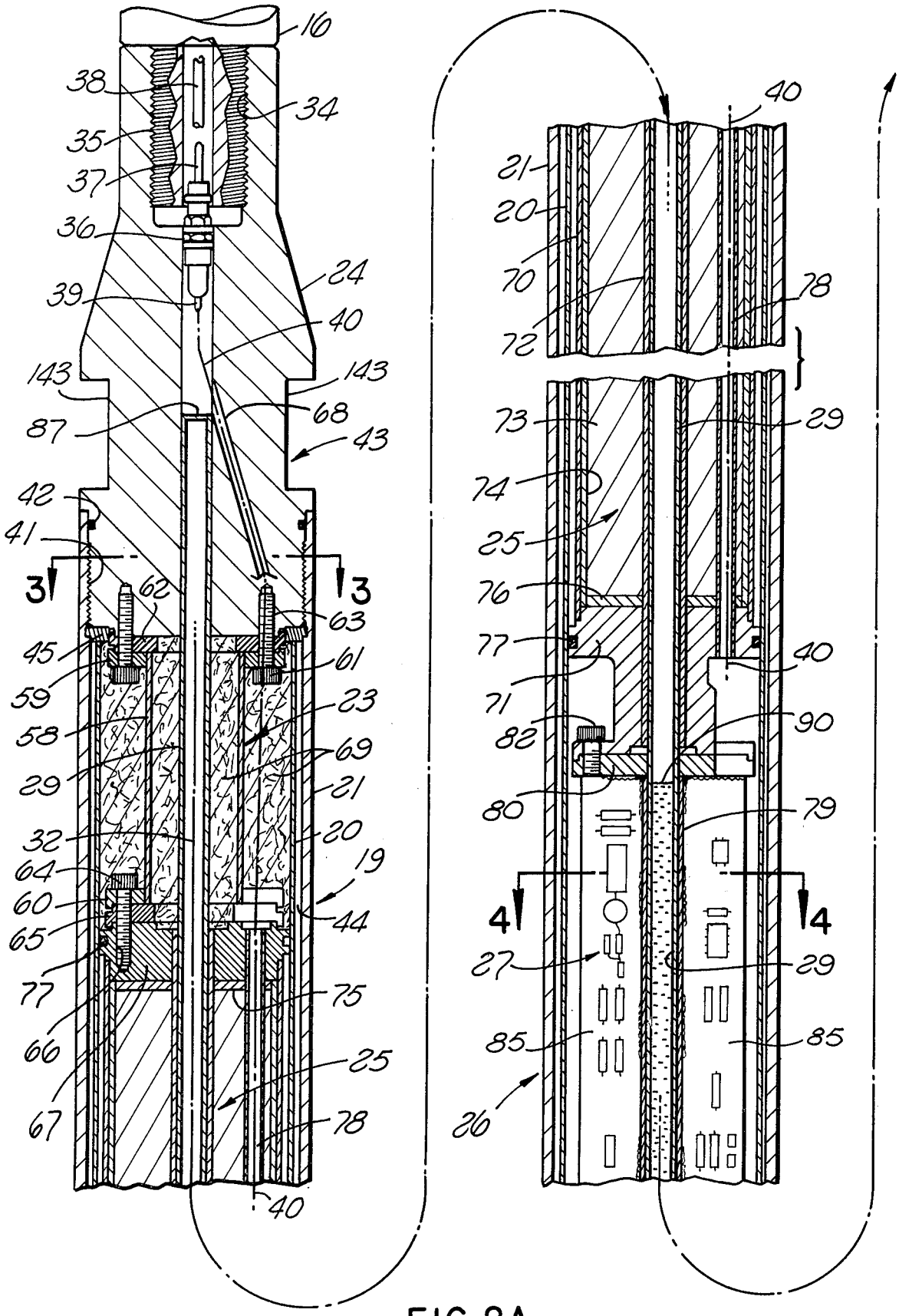
FIGS. 2A and 2B constitute together an enlarged fragmentary vertical section through the apparatus, taken on line 2—2 of FIG. 1.
Figure 2B:
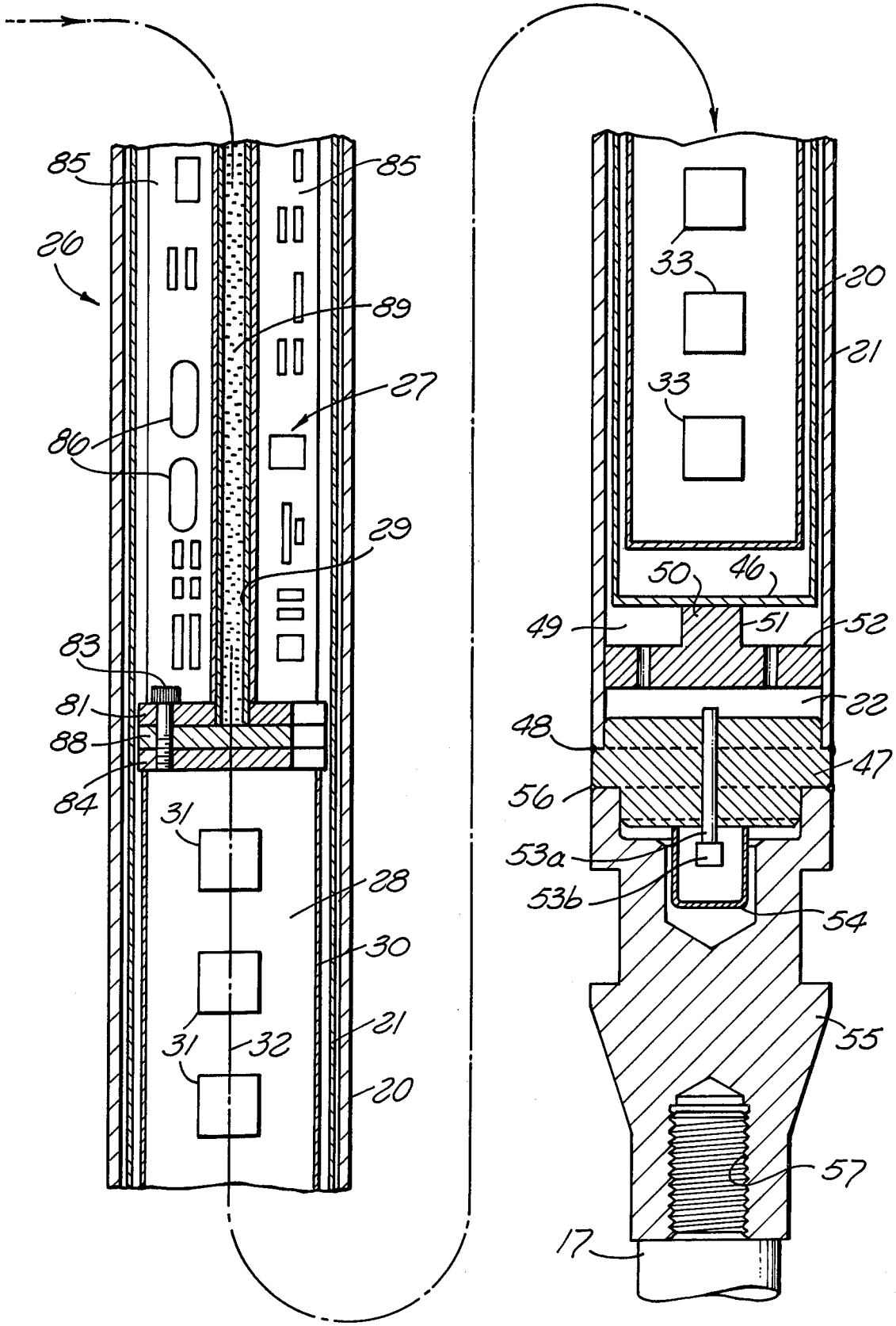

Referring now to FIGS. 2A and 2B, the survey device 10 includes a heat insulating jacket structure consisting of a dewar flask 19 having spaced inner and outer walls 20 and 21 and a closed double wall bottom portion 22, with the top portion of the insulating jacket being formed by a thermal isolator 23 extending downwardly within the top of the dewar. A heat conductive end cap 24 at the top of the device 10 is connected by the thermal isolator 23 to a heat sink 25 beneath the isolator, and an instrument assembly 26 including an electronic section 27 and an instrument proper 28, with all of these units 25, 27 and 28 being suspended from cap 24 and line 13 through the mechanical connection formed by thermal isolator 23. Heat is conducted vertically through the device by a heat pipe 29.

It is contemplated broadly that the instrument 28 may be any type of device capable of sensing or responding to one or more conditions in the well, or performing another desired function deep within the well. When the device 10 is intended for surveying purposes, instrument 28 may include a housing 30 containing three sensors 31 for sensing and responding to different components of the inclination of axis 32 of the device 10 and instrument 28 relative to the vertical, and three additional sensors 33 for sensing and responding to different components of the directional orientation of housing 30 with respect to true North or magnetic North. More particularly, the three sensors 31 may be accelerometers sensing three components of inclination with respect to three different mutually perpendicular axes, and the sensors 33 may be three flux gates or gyro devices responsive to directional components with respect to the same axes referred to in connection with inclination sensors 31. The signals produced by sensors 31 and 33 are delivered to electronic section 27, and are processed by the circuitry of that section to develop output signals which are conducted through cable 13 and the ground to readout unit 15 at the surface of the earth, which contains additional circuitry for processing the signals to produce readouts representing the inclination of the bore hole at the location of device 10, the direction of that inclination, and/or other desired survey information.

Cap 24 is formed of a heat conductive material which is exposed to direct contact with liquid or air in the well and which is therefore subjected directly to the high temperatures of the earth formation surrounding the well. At its upper end, cap 24 has an internally threaded bore 34 engageable with external threads 35 formed on the lower end of the upper centering and locating portion 16 of the downwhole assembly. An electrical connector 36 may be connected into the upper end of cap 24 at a central location, and have an upwardly projecting pin 37 attached by an appropriate connector to the conductor 38 of wire line 13, to conduct electricity between the wire line and a downwardly projecting pin 39 of connector 36 to which a conductor 40 leading to electronic section 27 is connected. At its lower end, cap 24 may have external threads engaging internal threads of outer wall 21 of dewar 19 at 41 in suspending relation. A seal ring 42 received within an external groove in cap 24 above threads 41 engages an internal cylindrical surface in the upper extremity of barrel 21 to form an annular seal therebetween. At a location slightly above the upper end of the outer tube 21, cap 24 may have an externally non-circular portion 43, typically defined by two parallel flat surfaces 143 at its oppostie sides, for engagement by a wrench to screw the cap into engagement with the parts 16 and 21.

The outer casing 21 of dewar 19 is preferably internally and externally cylindrical, as is inner wall 20, with both of these walls being concentric about the main longitudinal axis 32 of the survey device. Parts 20 and 21 may be formed of an appropriate metal, preferably steel, with the outer wall 21 desirably having a radial thickness substantially greater than inner wall 20 to enable the outer wall to serve the purpose of withstanding external pressure and rigidly interconnecting upper and lower portions of the device. Walls 20 and 21 are spaced apart about the entire periphery of wall 20 and along its entire axial extent to provide an annular space 44 therebetween from which all air and other gases are evacuated to provide as complete a vacuum as possible in that space preventing conduction of heat between the two walls 20 and 21. This space is sealed off at its upper end by an annular ring 45 which is welded annularly to both of the walls 20 and 21. At its lower end, inner wall 20 of the dewar is closed by a transverse bottom wall 46, while the bottom of outer wall 21 is closed by a transverse plug 47 welded annularly to wall 21 at 48. The vacuum space 44 between walls 20 and 21 thus is in communication with a lower vacuum space 49 vertically between bottom walls 46 and 47. The lower portion of inner wall 20 of the dewar may be located in centered relation with respect to outer wall 21 by provision of a centering element 50 formed of heat insulative material and having a projection 51 secured rigidly to the bottom of the inner portion of the dewar and an enlarged diameter flange 52 engaging the interior of a downwardly projecting portion of wall 21 in locating relation. An evacuation tube **53*a* may extend through plug 47 and be connectable to a vacuum pump to initially evacuate the space between the inner and outer walls of the dewar, with a cap or plug 53*b* then being connected to tube 53*a* in sealed relation for closing off cummunication between the vacuum space and the exterior of the device after evacuation has been completed. A protective cap 54 may be placed about tube 53*a* and cap 53*b* after the vacuum has been sealed. A bottom connector part 55 may be secured to plug 47 as by an annular weld at 56, and may be connectable to the lower centering structure 17 by threads 57**.

Figure 3:
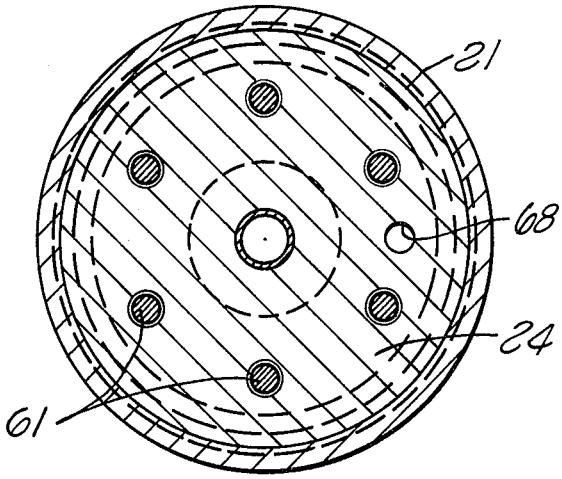
FIGS. 3 and 4 are further enlarged horizontal sections taken on lines 3—3 and 4—4 respectively of FIG. 2A.

The thermal isolator 23 is intended to form a structurally very strong connection between cap 24 and heat sink 25, but a connection which has low heat conductivity and in effect closes the upper end of the dewar against downward intrusion of heat thereinto. For this purpose, the thermal isolator may include a thin wall metal or plastic tube 58 extending along and centered about axis 32 and welded annularly at its opposite ends to a pair of connector rings 59 and 60. A series of circularly spaced bolts 61 extend through ring 59 and a second ring 62 of heat insulative material and connect threadedly into cap 24 at 63 and thereby form the desired rigid aligned connection between the thermal isolator and the cap. A similar connection is formed at the opposite end of the thermal isolator by circularly spaced bolts 64 extending through openings in flange 60 and a heat insulative ring 65 and connecting threadedly at 66 into an annular upper end wall 67 of the heat sink cannister 25, to thereby support the heat sink and parts therebelow from the thermal isolator. The conductor 40 from cable 13 extends downwardly past the isolator in any appropriate manner, as by extension through openings 68 (FIG. 3) in rings 59, 60, 62 and 65. Heat pipe 29 extends downwardly through tube 58 of the thermal isolator, in annularly spaced but centered relation with respect thereto. Annular bodies 69 of fiberglass wool or other insulating material are received within the spaces radially between tube 58 and the heat pipe, and between tube 58 and inner wall 20 of the dewar, to prevent conduction of heat radially inwardly through isolator 23 to the heat pipe or downwardly through the isolator from cap 24 to heat sink 25.

Extending downwardly from its top wall 67, the heat sink cannister has an outer cylindrical wall 70, welded annularly at its upper end in sealed relation to transverse wall 67, and welded annularly at its lower end to a second transverse wall or end piece 71. An inner tube 72 of the cannister connects with the other parts to form a closed annular space filled by a body of material 73 selected to melt at a temperature which the operating electronic components of section 27 can withstand and to which those components and instrument 28 may be heated in use of the tool at a downhole location. This material 73 is selected to have a high heat of fusion in order to absorb a great deal of heat upon melting while maintaining the rest of the equipment within the dewar at a constant temperature. As an example, the heat sink material 73 may be an appropriate low melting temperature bismuth alloy compounded to melt at an appropriate temperature, such as for example the product sold by Cerro Metal Products of Bellefonte, Pennsylvania as "Cerrobend", which melts at a temperature of one-hundred and fifty eight degrees Fahrenheit (158° F.). Other similar materials melting at different temperatures may be utilized depending upon the operating temperature of the instrument assembly 26, the amount of heat produced by the sensing instrument and electronic package, the structure of the heat pipe, and other factors. In order to allow for expansion and contraction of the fusible material 73 upon solidification or melting, the heat sink cannister may be lined by deformable and compressible cushioning material including a tubular cushion 74 within side wall 70 of the heat sink cannister and transverse end cushions 75 and 76 adjacent end elements 67 and 71 respectively. Two rubber 0-rings 77 may be received within grooves in parts 67 and 71 to engage the inner surface of inner wall 20 of the dewar and locate the heat sink cannister in centered and cushioned relation with respect thereto. The electrical conductor from cable 13 may extend downwardly past the heat sink cannister through a tube 78 connected into elements 67 and 71 at an off-center location and extending parallel to tube 72 and the axis of the device. Tube 72 is internally cylindrical and closely engages the outer cylindrical surface of heat pipe 29 for effective transmission of heat through the wall of the heat pipe and then through tube 72 to heat-of-fusion material 73.

Figure 4:
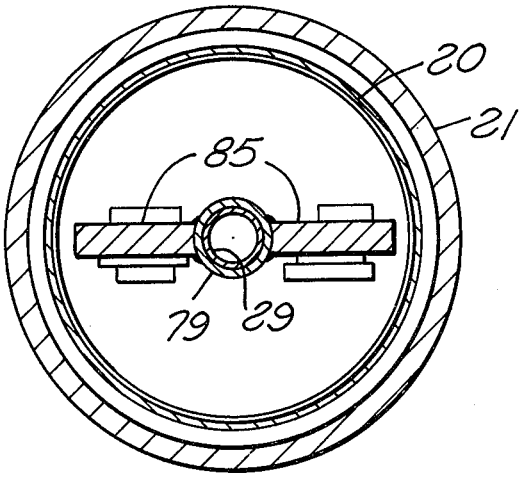

The electronic section 27 includes a tube 79 having an inner cylindrical surface centered about axis 32 and closely engaging the outer cylindrical surface of heat pipe 29 in heat conducting relation for effective transmission of heat radially inwardly from tube 79 to the heat pipe. The tube 79 is formed of a highly heat conductive material, for example aluminum, having flanges 80 and 81 welded or otherwise rigidly secured to its opposite ends and then connected by two series of circularly spaced bolts 82 and 83 to end part 71 of the heat sink and upper transverse heat conductive end wall 84 of instrument 28. Between these flanges 80 and 81, tube 79 may have two oppositely diametrically projecting fins 85 of heat conductive material (see FIG. 4), which may be welded or otherwise attached rigidly to tube 79 or formed integrally therewith by extrusion. All of the electronic components and circuitry 86 of section 27 may be attached to opposite sides of the fins 85, in heat conductive relation thereto, so that the heat generated by the electrical circuitry can pass through the fins and tube 79 to heat pipe 29.

The heat pipe 29 may take the form of a single straight cylindrical vertically extending pipe or tube of heat conductive material, typically steel, copper.or aluminum, centered about the main longitudinal axis 32 of the device. The upper end of the heat pipe is closed by a top wall 87 welded or otherwise secured to the heat pipe, and its lower end is closed by a transverse flange 88 extending across the bottom of the tube and welded or otherwise secured thereto in sealed relation. This flange is clamped between the upper wall 84 of instrument 28 and the lower wall 81 of electronics section 27 by screws 83 to transfer heat from walls 81 and 84 to flange 88 and the heat pipe. A liquid 89 is contained within the interior of the heat pipe, preferably up to a level 90 at the top of electronic section 27. Alternatively, the liquid level in the heat pipe may be lower than the level 90 of FIG. 2A, in which event the heat pipe may contain a wick extending upwardly from beneath the surface of the liquid to the location 90 to convey some of the liquid upwardly to that point by capillary action. The liquid within the heat pipe may be any appropriate liquid which will be evaporated by temperatures encountered within instrument 28 and electronic section 27 and will then condense within the heat sink cannister to transfer latent heat from the condensing fluid to the fusible material 73 and progressively melt that material.

To now describe a cycle of use of the illustrated assembly, assume that the device is initially at the surface of the earth and at ambient temperature, say for example seventy degrees Fahrenheit (70° F.), with the various elements within the interior of the dewar also at that temperature. As the device is lowered into the well, the instrument 28 and the electronics within section 27 may be continuously or intermittently energized to produce survey information, and in doing so may produce electrically developed heat. This heat may pass through flange 88 and tube 79 into the liquid 89 within the heat pipe, ultimately raising its temperature high enough to evaporate some of that liquid causing its vapor to rise upwardly within the heat pipe to the interior of heat sink 25 and to the portion of the heat pipe within cap 24. If the temperature within the well is lower than that within dewar 19, the low temperature of cap 24 will condense the vapors in contact with the upper portion of the heat pipe in cap 24, with resultant conduction of the heat of condensation to the cap so that the cap may function as a convector transmitting the heat to the surrounding air or well fluid and formation.

As the device is lowered into the well, the temperature of the surrounding formation and fluid or air in the well gradually increases, until ultimately it reaches a temperature greater than the temperature of instrument 28, electronic section 27, and heat sink 25, at which time the cap 24 is no longer cool enough to condense vapors within its interior, and consequently conduction of heat to the cap from the interior of the dewar is terminated. Instead, vapors which are evaporated from liquid 89 by heat developed in electronic section 27 and instrument 28 are condensed by the cooler heat sink 25, converting the vapors to liquid within the interior of the portion of the heat pipe located inside the heat sink, so that the heat of condensation may be conducted radially outwardly through the heat pipe to the heat of fusion material 73 in the heat sink, gradually raising its temperature. When the temperature of the heat sink material 73 reaches its melting point, that material commences to melt and to absorb large amounts of latent heat without further elevation of the temperature of material 73, instrument 28 or section 27. Thus, heat can be transferred progressively over a long period of time from sections 27 and 28 to the heat sink while protecting sections 27 and 28 against undue rise in temperature and assuring their proper functioning. At the same time, thermal isolator 23 prevents conduction of substantial heat downwardly to the heat sink and other elements within dewar 19. Heat pipe 29 functions as a heat diode preventing downward conduction of heat through pipe 29 while permitting upward conduction of heat by the evaporation process.

After the device has served its purpose in the well and has been withdrawn from the well, it may then be turned to a horizontal condition in which the liquid 89 within the heat pipe can simultaneously contact the heat pipe along it entire length, and permit transmission of heat from heat sink 25 and sections 27 and 28 to cap 24, from which the heat radiates to the atmosphere, all in a manner cooling the apparatus very quickly for the next successive operation.

While a certain specific embodiment of the present invention has been disclosed as typical, the invention is of course not limited to this particular form, but rather is applicable broadly to all such variations as fall within the scope of the appended claims.

I claim:

1. A thermally protected well device comprising:

a vertically elongated heat insulating jacket structure adapted to be lowered into a well;

an instrument within said jacket structure and insulated thereby from the heat of the surrounding earth formation;

a heat sink within and insulated by said jacket structure and located above said instrument;

a heat pipe having a portion extending upwardly within the jacket structure from the instrument to the heat sink and containing a liquid which only partially fills the heat pipe and acts by evaporation at a lower level and condensation at a higher level to transmit heat upwardly from said instrument to the heat sink but not downwardly therebetween;

said jacket structure including heat insulating top and bottom portions thereof located above the heat sink and beneath the instrument respectively and acting to resist conduction of heat downwardly from the exterior of the jacket structure through said top portion to said heat sink and instrument or upwardly thereto through said bottom portion; and including a heat insulating side wall structure extending about said heat sink and instrument between said top and bottom portions and resisting conduction of heat radially inwardly from the exterior of the jacket structure to the heat sink and instrument and said portion of the heat pipe extending therebetween.

2. A well device as recited in claim 1, in which said heat sink is disposed about said heat pipe in heat conducting relation therewith.

3. A well device as recited in claim 1, in which said heat pipe has a portion which projects upwardly beyond said heat sink and to the exterior of said insulating jacket structure and within which vapors in the heat pipe can condense in a relation conducting heat from the interior to the exterior of the jacket structure when the instrument and heat sink are warmer than the surrounding formation, but preventing substantial reverse flow of heat from the formation when it is warmer than the instrument and heat sink.

4. A well device as recited in claim 1, including electronic circuitry in heat conducting relation with said heat pipe and contained within a space radially between a portion of the heat pipe and a surrounding portion of said insulating jacket structure.

5. A well device as recited in claim 1, in which said top portion of said insulating jacket structure includes a thermal isolator unit connected to the upper end of said heat sink and suspending said heat sink and instrument within the well and constructed to resist conduction of heat through said isolator.

6. A well device as recited in claim 1, in which said heat sink includes a material adapted to be melted by condensation of vapors in the heat pipe in a relation absorbing heat of fusion without substantial rise in temperature of the melting material and thereby maintaining said instrument and heat sink against excessive rise in termperature.

7. A well device as recited in claim 1, including an electronic section within and insulated by said jacket structure and disposed about said heat pipe and having at least one heat conductive fin at the outside of said heat pipe in heat conducting relation therewith, and electronic circuitry carried by said fin for conduction of heat from said circuitry through said fin to the heat pipe.

8. A thermally protected well device comprising:

a vertically elongated dewar adapted to be lowered into a well and having spaced side walls with a vacuum radially therebetween for blcoking conduction of heat laterally inwardly from the exterior of the dewar to its interior;

an instrument within said dewar and insulated thereby from the heat of the surrounding earth formation;

a heat sink within and insulated by said dewar and located above said instrument; and a heat pipe having a portion extending upwardly within the dewar from the instrument to the heat sink and containing a liquid which only partially fills the heat pipe and acts by evaporation at a lower level and condensation at a higher level to transmit heat upwardly from said instrument to the heat sink but not downwardly therebetween;

said dewar having top and bottom walls at the upper and lower ends of said side wall structure and located above the heat sink and beneath the instrument respectively and acting to resist conduction of heat downwardly from the exterior of the dewar through said top portion to said heat sink and instrument or upwardly thereto through said bottom portion.

9. A well device as recited in claim 8, in which said heat pipe has a portion which projects upwardly beyond said heat sink and through said top wall of the dewar to the exterior thereof and within which vapors in the heat pipe can condense in a relation conducting heat from the interior to the exterior of the dewar when the instrument and heat sink are warmer than the surrounding formation, but preventing effective reverse flow of heat from the formation when it is warmer than the instrument and heat sink.

10. A well device as recited in claim 8, in which said heat sink includes a material disposed about said heat pipe above said instrument and adapted to be melted by heat derived from condensation of vapors within the heat pipe.

11. A well device as recited in claim 8, in which said heat sink includes a material adapted to be melted by condensation of vapors in the heat pipe.

12. A well device as recited in claim 8, in which said top wall of the dewar comprises a thermal isolator unit connected to the upper end of said heat sink and suspending said heat sink and instrument within the dewar and constructed to resist conduction of heat vertically through the isolator.

13. A well device as recited in claim 8, in which said heat pipe has an upper portion projecting upwardly bebeyond said top wall of the dewar, there being a heat conducting convector element above said top wall in heat conducting relation with said upper portion of the heat pipe and exposed in heat conducting relation with well fluid or air or the earth formation at the outside of the dewar and adapted to receive heat from said heat pipe by condensation of vapors therein while resisting heat flow downwardly from said convector element through the heat pipe to said heat sink and instrument.

14. A well device as recited in claim 13, in which said convector element is adapted for connection to a structure suspending it and the remainder of said unit in the well.

15. A well device as recited in claim 13, in which said top wall of the dewar is disposed about said heat pipe within an upper portion of the dewar and acts to suspend said heat sink and instrument from said convector element while resisting conduction of heat downwardly into the upper end of the dewar through said top wall about the heat pipe.

16. A combination as recited in claim 15, in which said heat sink includes a body of heat-of-fusion material disposed about said heat tube above the instrument and adapted to be melted by heat drived from condensation of vapors in the heat pipe.

17. A well device as recited in claim 16, in which said bottom wall of the dewar includes vertically spaced walls with a vacuum therebetween.

18. A well device as recited in claim 17, including an electronic section disposed about said heat pipe between said instrument and said heat sink and containing electronic circuitry radially between the heat pipe and said side wall structure of the dewar and in heat conducting relation with the heat pipe for transmission of heat thereto.

19. The combination as recited in claim 18, including a heat conductive flange connected to the lower end of said heat pipe beneath said electronic section and in heat conducting relation with an upper wall of said instrument to receive heat therefrom.

20. The combination as recited in claim 8, in which said bottom wall of the dewar includes vertically spaced walls with a vacuum therebetween.

* * * * *